US006827794B2

(12) United States Patent
Sommerfeld, Sr.

(10) Patent No.: US 6,827,794 B2
(45) Date of Patent: Dec. 7, 2004

(54) AIR GAP CLEANING METHOD

(76) Inventor: Paul A. Sommerfeld, Sr., 4-L Fallon Ct., Baltimore, MD (US) 21236

( * ) Notice: Subject to any disclaimer, the term of this patent is extended or adjusted under 35 U.S.C. 154(b) by 506 days.

(21) Appl. No.: 10/045,784

(22) Filed: Jan. 10, 2002

(65) Prior Publication Data

US 2003/0127109 A1 Jul. 10, 2003

(51) Int. Cl.[7] ..... A46B 3/18; B08B 1/00; B08B 9/04

(52) U.S. Cl. ..... 134/8; 15/104.2; 15/104.05; 15/206

(58) Field of Search ..... 134/6, 8; 15/104.2, 15/104.05, 206

(56) References Cited

U.S. PATENT DOCUMENTS

| | | | | |
|---|---|---|---|---|
| 3,582,140 A | 6/1971 | Kaufman et al. | ..... | 300/21 |
| D316,488 S | 4/1991 | Stormby | ..... | D4/131 |
| 5,836,032 A | 11/1998 | Hondo | ..... | 15/104.32 |

*Primary Examiner*—Zeinab El-Arini
(74) *Attorney, Agent, or Firm*—Armstrong, Kratz, Quintos, Hanson & Brooks, LLP

(57) ABSTRACT

A method of cleaning an air gap in a plumbing fixture by removing the cap from a counter table access and inserting a flexible wire brush into a hose connecting the counter-top access to the drain opening.

2 Claims, 7 Drawing Sheets

AIR GAP CLEANING METHOD

BACKGROUND OF THE INVENTION

1. Field of the Invention

The present invention relates to a cleaning tool used in plumbing and more particularly to a brush used for cleaning an air gap.

2. Description of the Prior Art

The use of brushes for cleaning is known in the prior art as shown in U.S. Pat. Nos. D 316,488; 3,582,140 and 5,836,032. Also, cleaning brushes are commercially available from E. H. Sargent &Co.

However, these brushes have special features designed for particular uses. None of the brushes are adapted for use as an air gap cleaner in plumbing fixtures and more specially for cleaning the air gap which is present in a fixture having a dishwasher and an under-the-counter garbage disposal. This particular air gap is susceptible to the accumulation of deposits and must be cleaned on a regular periodic basis to ensure proper operation of the plumbing fixtures.

BRIEF SUMMARY OF THE INVENTION

It is an objective of the present invention to provide a method for cleaning the air gap in a plumbing fixture.

In accordance with the teachings of the present invention, there is disclosed a method of cleaning an air gap in a plumbing fixture which has a counter top access connected by a hose to a drain opening, the hose having a length. A cap is removed from the counter top access exposing a cylindrical fitting having a center tube spaced apart from the cylindrical fitting. The cylindrical fitting is connected to the hose, the hose leading to a drain opening in the garbage disposal. There is provided a cleaning brush having a wire handle which has a length greater than the length of the hose, the wire handle being flexible. A plurality of bristles extend circumferentially outwardly from a first end of the handle. The first end of the cleaning brush is introduced into the space between the cylindrical fitting and the center tube. The cleaning brush is fully inserted into the hose connected to the cylindrical fitting until the bristles on the first end of the cleaning brush exits the drain opening. The cap is replaced on the counter-top access.

These and other objects of the present invention will become apparent from a reading of the following specification taken in conjunction with the enclosed drawings.

DESCRIPTION OF THE PREFERRED EMBODIMENTS

Figure 1:
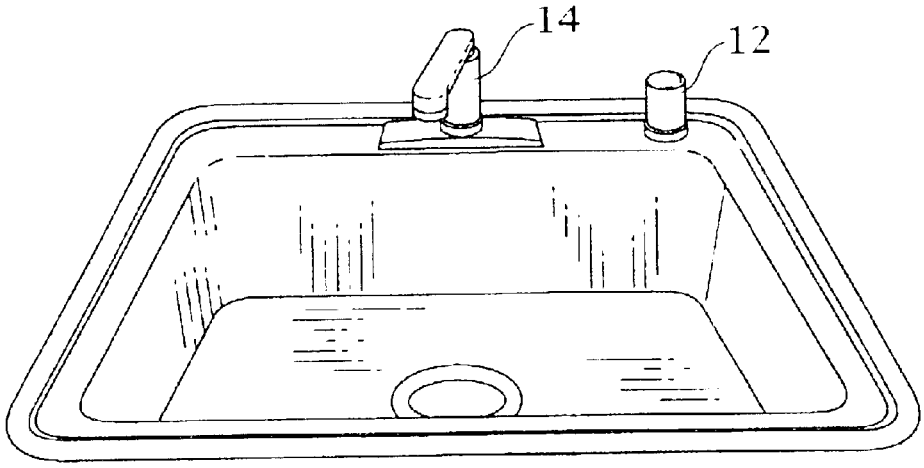
FIG. 1 is a perspective view of a sink having a faucet and a cap for a counter-top access to an air gap.
Figure 2:
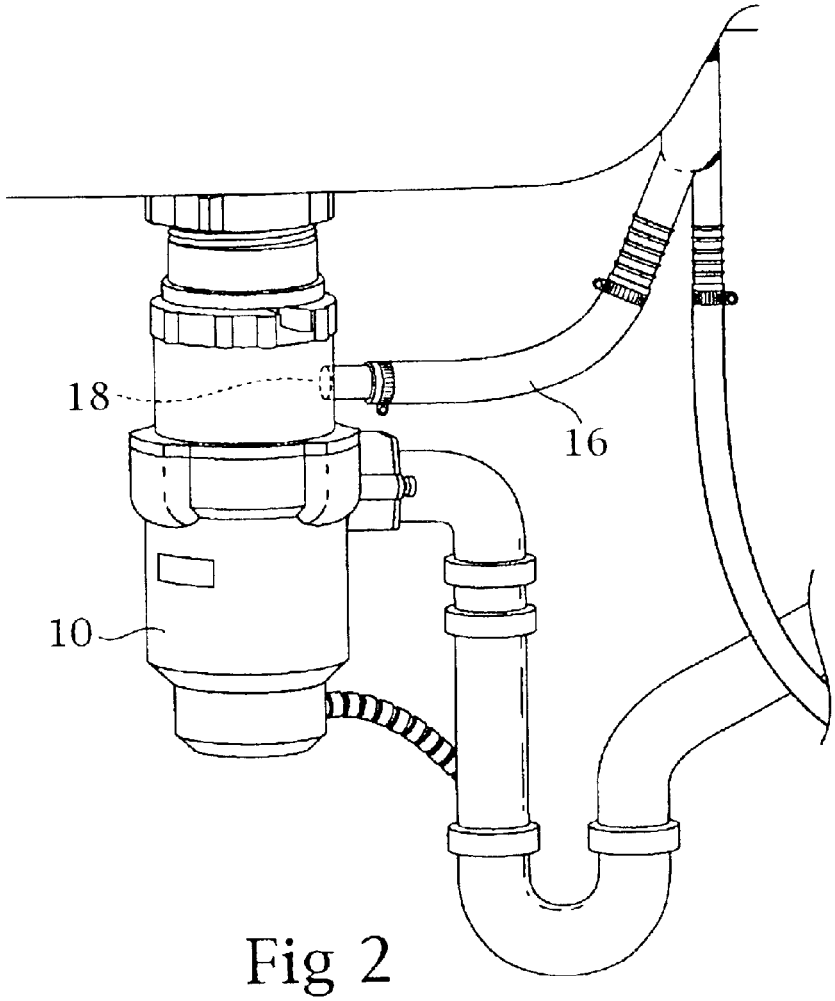
FIG. 2 is a perspective view of the garbage disposal mounted under the counter and connected by a hose to the counter-top access.

Referring now to FIGS. 1 and 2, plumbing fixtures such as a dishwasher and an under-the-counter garbage disposal 10 connected to the drain line of a sink frequently have a counter-top access 12 located adjacent to the faucet 14. The counter-top access 12 is connected to a hose 16 which has a length and leads to a drain opening 18 in the sink.

In the prior art, the hose 16 becomes clogged due to the accumulation of deposits in the hose. When the hose becomes clogged, water backs up in the hose 16 and overflows through the counter-top access 12 and onto the counter-top and the floor.

To repair the clogged hose, a plumber must remove the hose 16 between the drain opening 18 and the counter-top access 12 and clean the inside of the hose by flushing or by using a wire. Usually, when the clamps which hold the hose are removed, the hose is damaged or the hose is in need of replacement.

The present invention eliminates the need to remove the hose 16.

Figure 3:
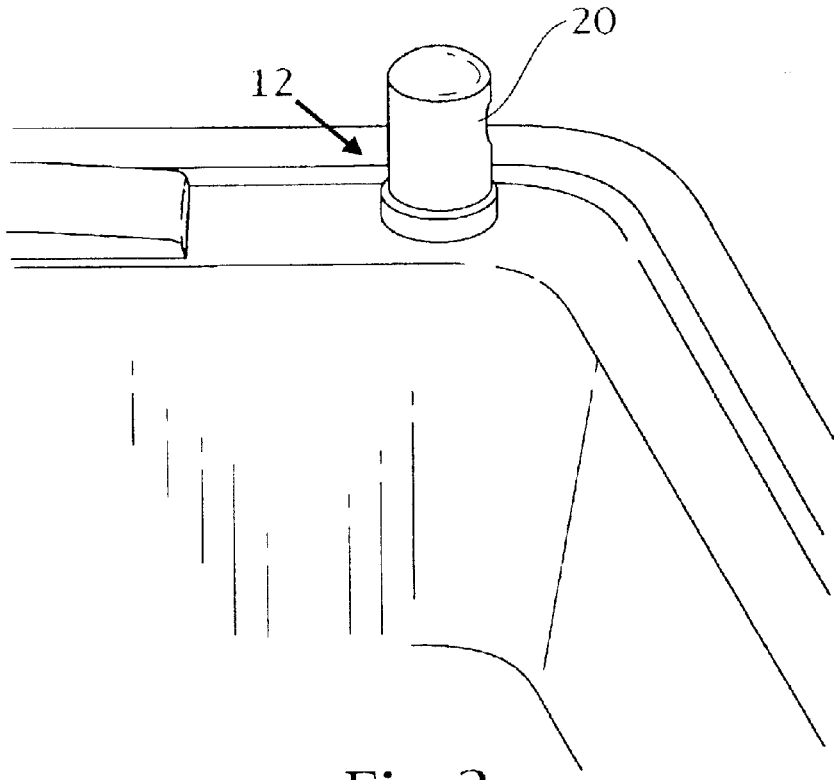
FIG. 3 is a closeup view of the cap on the counter-top access.
Figure 4:
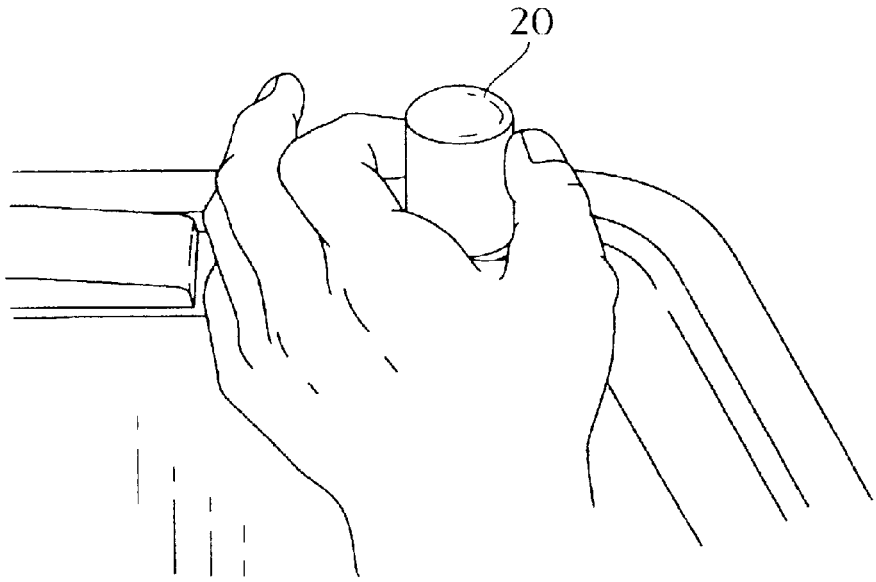
FIG. 4 is a perspective view showing loosening of the cap from the counter-top access.
Figure 5:
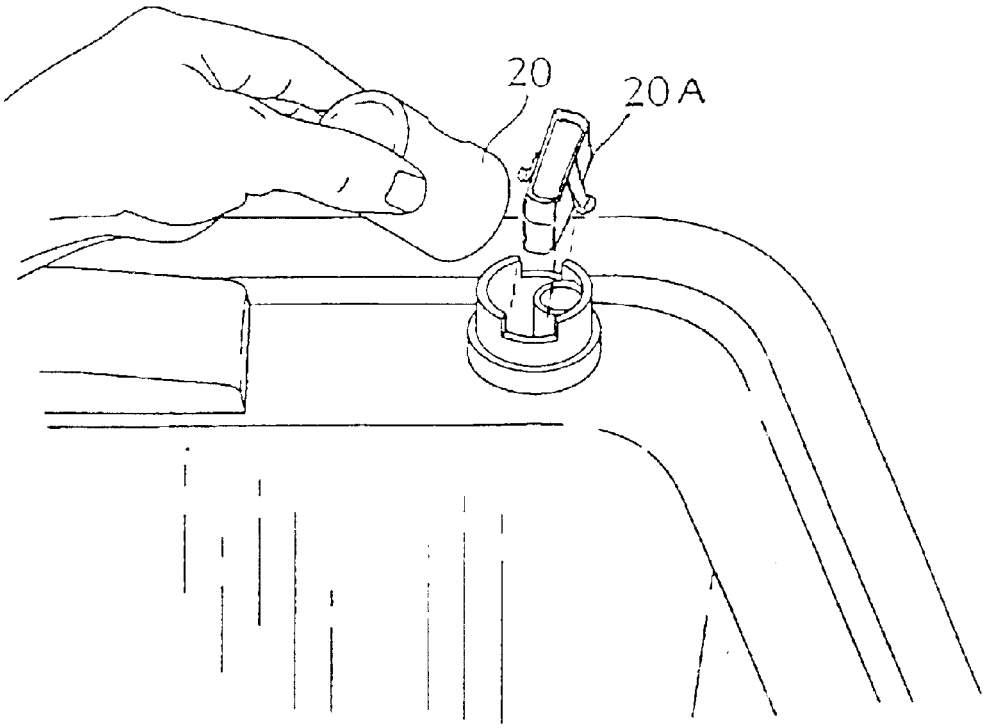
FIG. 5 is a perspective view showing removal of the cap from the counter-top access.
Figure 6:
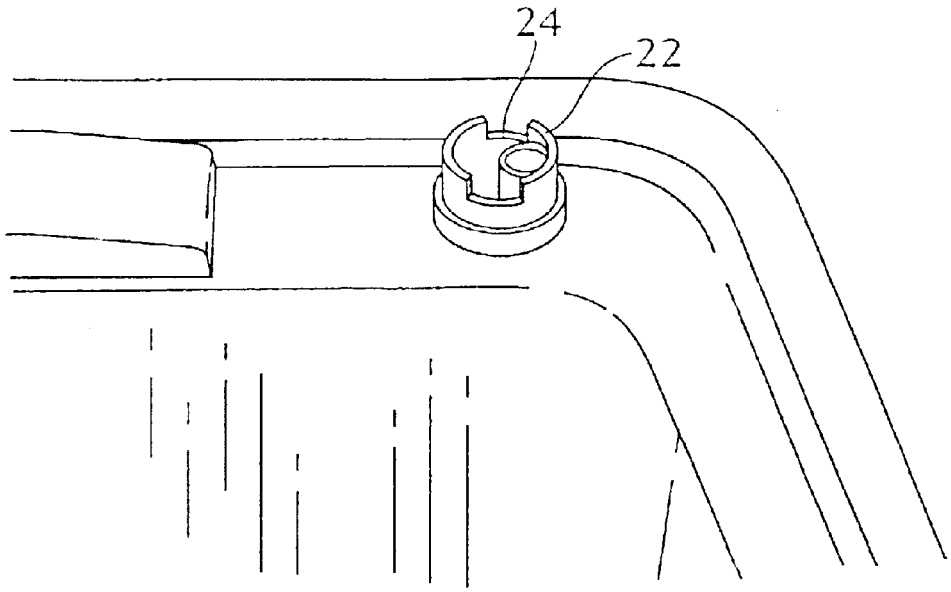
FIG. 6 is a perspective view of the counter-top access with the cap removed showing the cylindrical fitting with the center tube therein.
Figure 13:
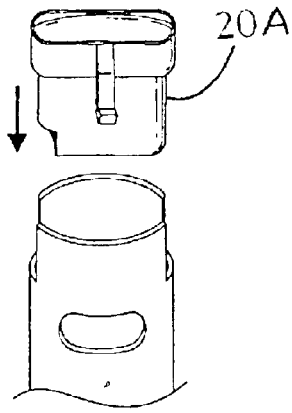
FIG. 13 is a perspective view of a deflector cap for the cylindrical fitting.

A cap 20 frictionally fits over the counter-top access 12. The cap 20 is made of metal or plastic. This cap 20 is removed by merely lifting it up (see FIGS. 3 and 4). When the cap 20 is removed, an inserted cap 20A (see FIGS. 5 and 13) is exposed. This inserted cap 20A is usually a molded plastic piece. To remove this inserted cap 20A, just squeeze the two ends and pull it out. Sometimes, an alternate cap has internal threads (not shown) which screw on to the fitting or counter-top screw 12. This exposes a cylindrical fitting 22 (FIGS. 5, 6). In some instances, a deflector cap may be disposed over the fitting 22 (FIG. 13). A center tube 24 is disposed within the cylindrical fitting 22. The cylindrical fitting 22 is connected to the hose 16 under the counter top.

Figure 7:
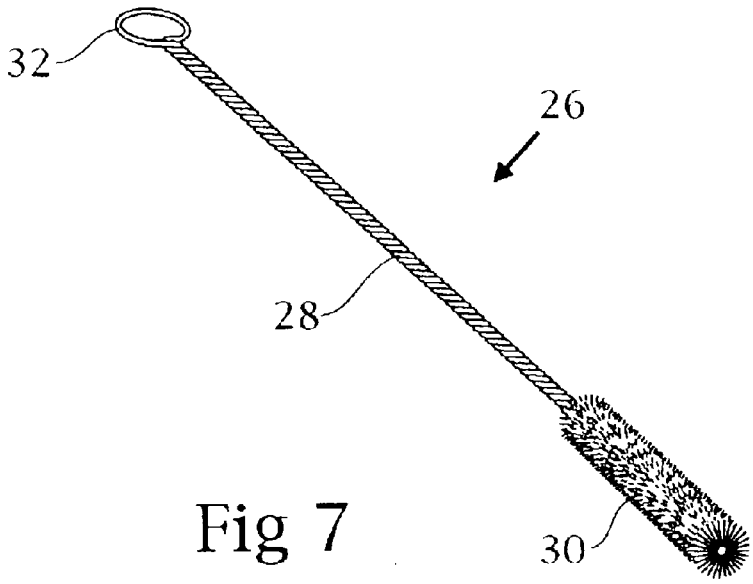
FIG. 7 is a perspective view of the cleaning brush.

A cleaning brush 26 has a flexible wire handle 28 (FIG. 7). Preferably, the wire handle 28 is formed of at least two members twisted together but the handle may be a single wire. A plurality of bristles 30 are attached to a first end of the cleaning brush 26 and extend circumferentially outwardly from the first end of the brush. Preferably, the bristles 30 are mounted along a length of approximately 2–3 inches on the first end of the brush although the length may be greater or less. A loop 32 may be formed at the opposite second end of the handle although the loop 32 may be eliminated.

Figure 8:
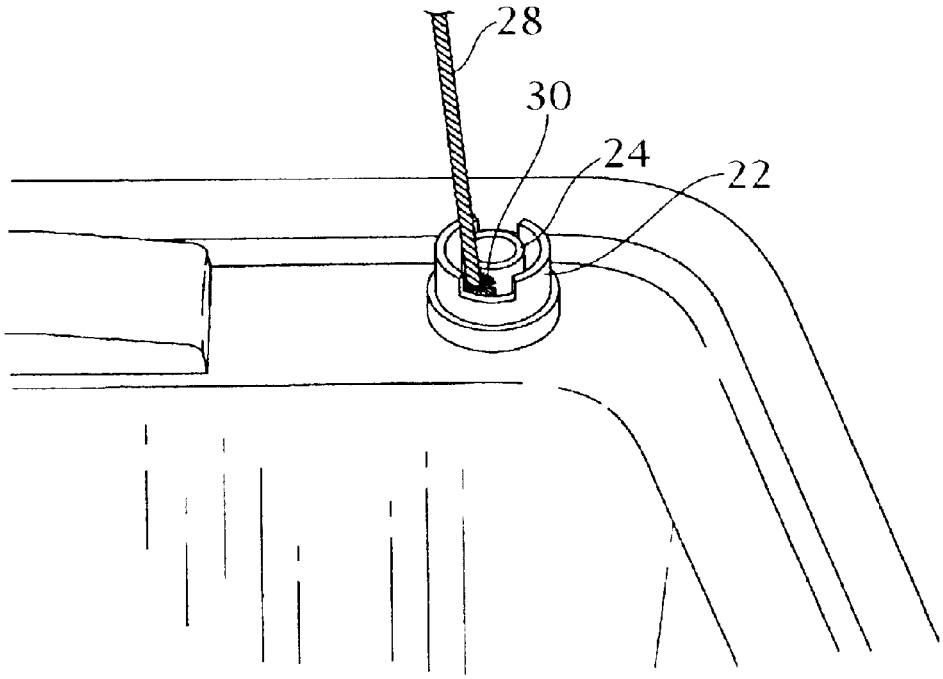
FIG. 8 is a perspective view showing the first end of the cleaning brush having bristles introduced into the space between the cylindrical fitting and the center tube.
Figure 9:
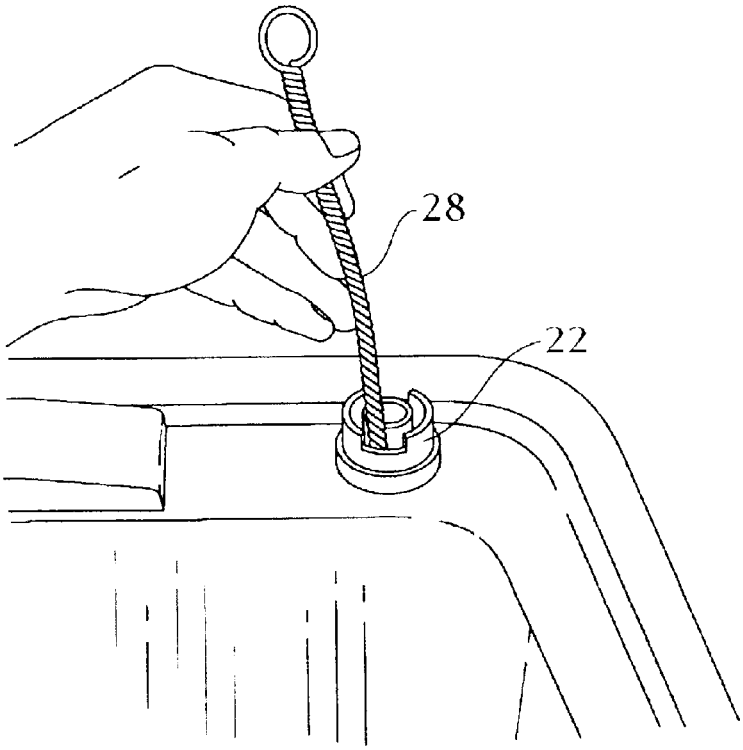
FIG. 9 is a perspective view showing the brush being inserted into the space between the fitting and the center tube.
Figure 10:
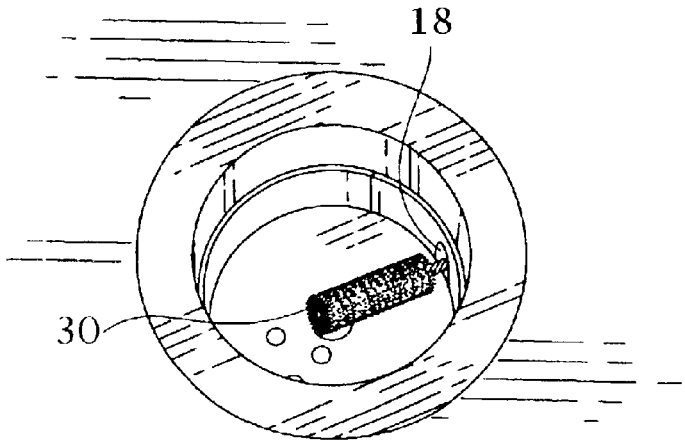
FIG. 10 is a top plan view into the sink showing the bristles on the first end of the brush exiting the drain opening in the sink drain.
Figure 11:
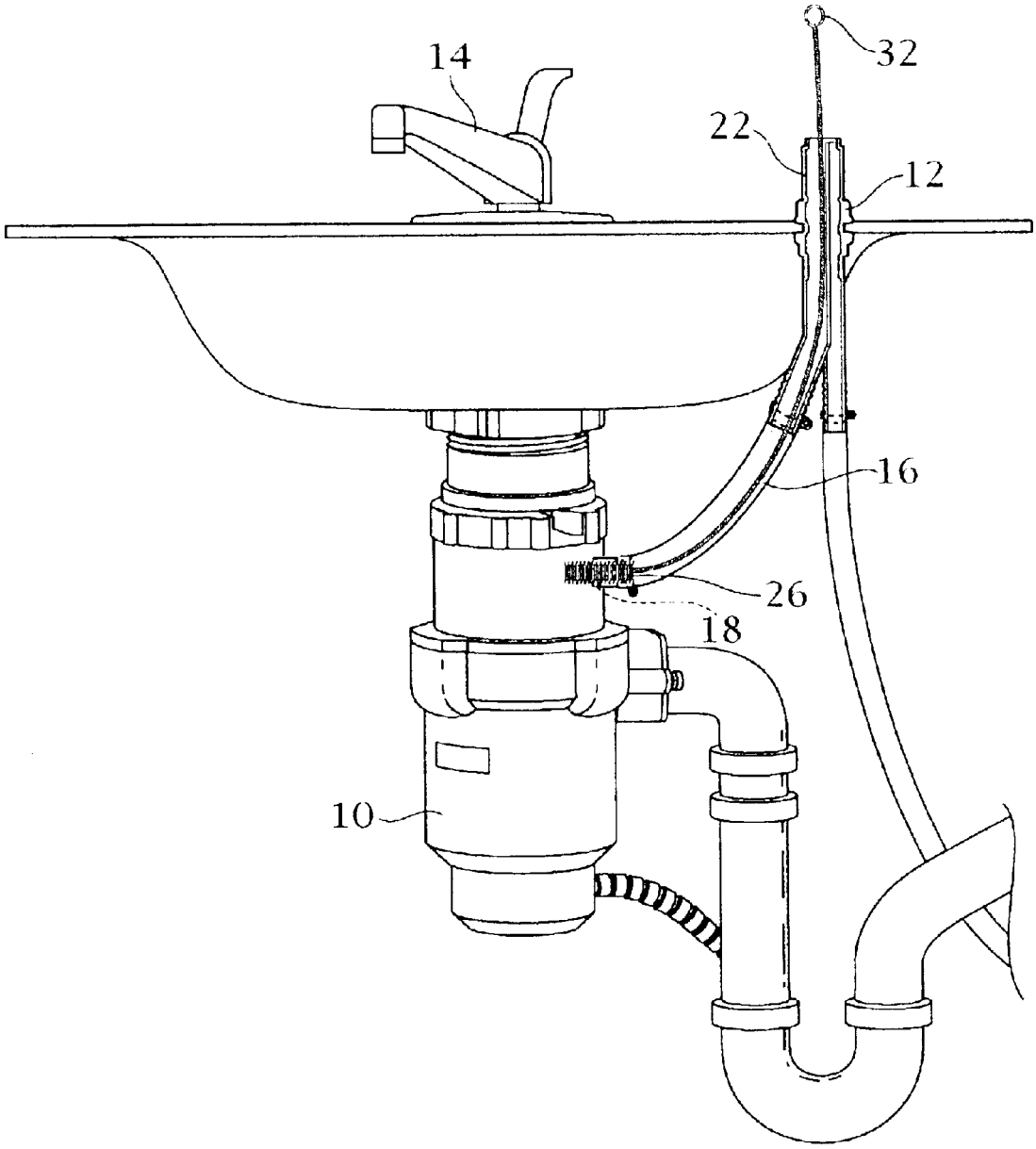
FIG. 11 is a partial cutaway drawing showing the method of using the cleaning brush to remove deposits from the hose.
Figure 12:
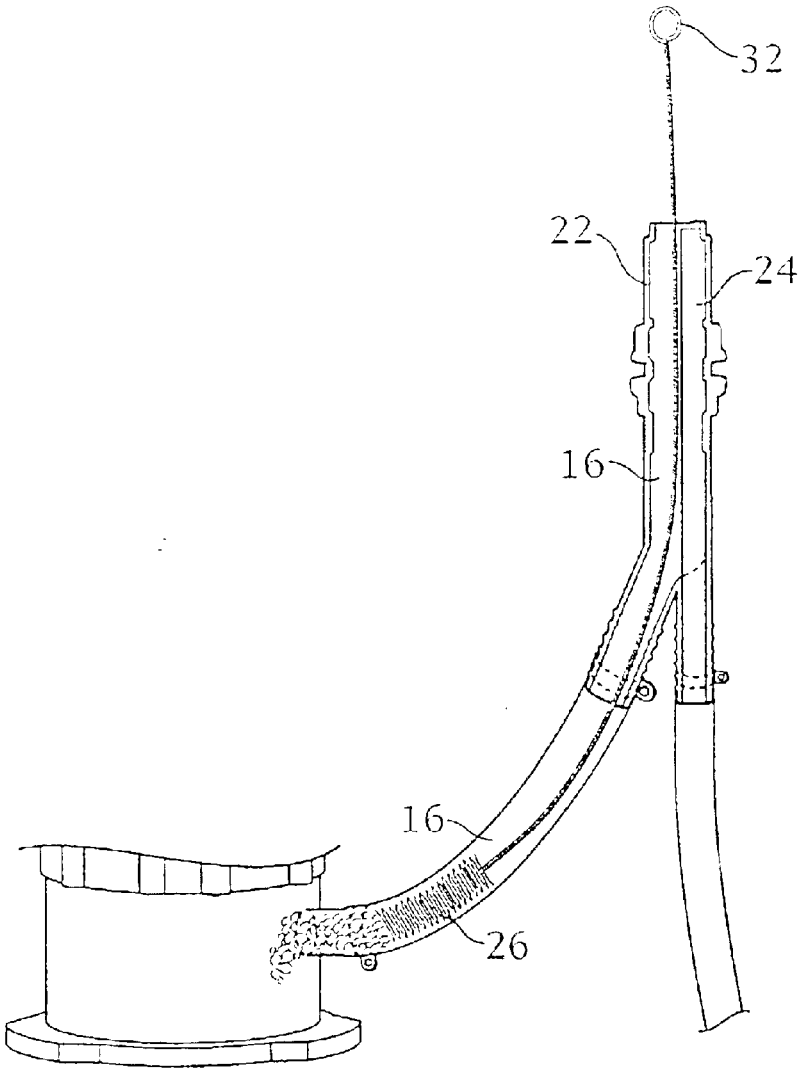
FIG. 12 is a cross-sectional view showing the brush within the cylindrical fitting.

The first end of the cleaning brush 26 with the bristles 30 is introduced into the space between the cylindrical fitting 22 and the center tube 24 (FIG. 8). The cleaning brush 26 is inserted fully into the space such that the bristles 30 on the first end pass through the inside of the hose 16. It is preferred that the bristles 30 of the brush have a length which is approximately equal to the inner diameter of the hose 16 to provide complete cleaning of the hose 16. The length of the cleaning brush 26 is greater than the length of the hose 16 and by inserting the cleaning brush 26, the deposits in the hose which are the cause of the clogging are pushed out of the hose 16 and through the drain opening 18 into the sink drain. The appearance of the bristles 30 exiting the drain opening 18 is the indication that the hose 16 has been cleaned (FIGS. 9–12).

In order to assure the cleaning of the hose, the procedure is repeated and water is introduced into the space between the cylindrical fitting 22 and the center tube 24 to rinse the cylindrical fitting 22 and the hose 16.

The cap 20 is replaced on the counter-top access. The clog has been removed without having to disconnect the hose. Thus, the plumbing fixture is again operational with minimum labor and in a much shorter period of time than has been possible without the present invention.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A method of cleaning an air gap in a plumbing fixture which has a counter-top access connected by a hose to a drain opening, the hose having a length, the method comprising the steps of:

removing a cap from the counter-top access, exposing a cylindrical fitting having a center tube spaced apart from the cylindrical fitting, the cylindrical fitting being connected to the hose, the hose leading to a drain opening, providing a cleaning brush having a wire handle which has a length greater than the length of the hose, the wire handle being flexible, a plurality of bristles extending circumferentially outwardly from a first end of the handle, introducing the first end of the cleaning brush into the space between the cylindrical fitting and the center tube, fully inserting the cleaning brush into the hose connected to the cylindrical fitting until the bristles on the first end of the cleaning brush exit the drain opening and replacing the cap on the counter-top access.

2. The method of claim 1, further comprising the steps of repeating said steps and rinsing the cylindrical fitting and the hose.

* * * * *